US008717731B2

(12) United States Patent
Reid et al.

(10) Patent No.: US 8,717,731 B2
(45) Date of Patent: May 6, 2014

(54) HYBRID CONTROL CIRCUIT BREAKER

(75) Inventors: Drew A. Reid, Brentwood, TN (US); Richard M. Elchik, Coraopolis, PA (US); Sandy Omar Jimenez, Monaca, PA (US)

(73) Assignee: Eaton Corporation, Cleveland, OH (US)

( * ) Notice: Subject to any disclaimer, the term of this patent is extended or adjusted under 35 U.S.C. 154(b) by 87 days.

(21) Appl. No.: 13/465,412

(22) Filed: May 7, 2012

(65) Prior Publication Data

US 2013/0293998 A1 Nov. 7, 2013

(51) Int. Cl.
*H01H 73/00* (2006.01)

(52) U.S. Cl.
USPC ..... 361/115; 335/14

(58) Field of Classification Search
USPC ..... 361/115; 335/14
See application file for complete search history.

(56) References Cited

U.S. PATENT DOCUMENTS

| | | | | |
|---|---|---|---|---|
| 4,167,716 | A * | 9/1979 | Horn | 335/14 |
| 5,301,083 | A | 4/1994 | Grass et al. | |
| 6,531,938 | B1 * | 3/2003 | Smith et al. | 335/14 |
| 6,888,431 | B2 | 5/2005 | Jordan | |
| 7,149,066 | B2 * | 12/2006 | Elms et al. | 361/47 |

* cited by examiner

*Primary Examiner* — Scott Bauer
(74) *Attorney, Agent, or Firm* — Eckert Seamans Cherin & Mellott, LLC; Kirk D. Houser

(57) ABSTRACT

Apparatus and systems and methods are described herein that provide a controlled circuit breaker that selectively interrupts a flow current associated with a first electrical phase and an uncontrolled circuit breaker that selectively interrupts current associated with a second electrical phase. The controlled circuit breaker and uncontrolled circuit breaker are coupled to one another and configured to be installed in adjacent slots in a circuit breaker panel.

20 Claims, 3 Drawing Sheets

HYBRID CONTROL CIRCUIT BREAKER

BACKGROUND

National energy codes first appeared in the 70's as a response to the global energy crisis. The historically high oil prices and the resulting shock to the economy prompted a focus on how energy is used and, more importantly, how it may be wasted. Little attention was paid to the efficiency of a building's design or cost of operation before that time. The American Society of Heating Refrigeration and Air-Conditioning Engineers (ASHRAE) was at the forefront of energy code development, publishing the first industry standard in 1975. This standard has continued to evolve with input from the building community and as new technology became available. With a purpose to reduce energy use while still maintaining occupant comfort, ASHRAE Standard 90.1 has become the standard for design and construction in the United States and has a strong influence on commercial building designs throughout the world. The 2010 revision to this standard includes a new requirement to reduce energy consumption by controlling plug load circuits.

SUMMARY

In one embodiment, an apparatus includes a controlled circuit breaker and an uncontrolled circuit breaker. The controlled circuit breaker is configured to input and output current generated by a first voltage phase. The controlled circuit breaker also includes a control mechanism operably coupled to a first pair of separable contacts that opens the first pair of separable contacts to interrupt the current generated by the first voltage phase in response to a control signal. The uncontrolled circuit breaker is configured to input and output current generated by a second voltage phase that is different than the first voltage phase. The uncontrolled circuit breaker also includes a trip mechanism configured to selectively open a second pair of separable contacts to interrupt the current generated by the second voltage phase in response to an overload event. The controlled circuit breaker and the uncontrolled circuit breaker are mechanically connected to one another in fixed relative positions such that when the apparatus is installed in a circuit breaker panel, the controlled circuit breaker and the uncontrolled circuit breaker are installed in adjacent slots.

In one embodiment, the controlled circuit breaker and the uncontrolled circuit breaker are configured to share a neutral conductor. In one embodiment, the controlled circuit breaker further includes a trip mechanism configured to open the first pair of contacts or, alternatively, a separate set of contacts, to interrupt the current generated by the first voltage phase in response to an overload event. The control mechanism may be a solenoid or a motor that responds to the control signal to separate the first pair, or alternatively, the separate set of contacts.

In one embodiment, the controlled circuit breaker includes a first handle manually operable to open a pair of contacts to interrupt the current generated by the first voltage phase. The uncontrolled circuit breaker also includes a second handle manually operable to open the second pair of contacts to interrupt the current generated by the second voltage phase. The apparatus further comprises a handle tie that mechanically couples the first handle to the second handle such that operation of one of the first and second handles will open the pair of contacts and the second pair of contacts to interrupt the current generated by the first voltage phase and the current generated by the second voltage phase.

In one embodiment, the apparatus includes a common trip mechanism coupled between a pair of contacts in the controlled circuit breaker and the second pair of contacts in the uncontrolled circuit breaker. The common trip mechanism is configured to, in response to opening of one of the pair of contacts and the second pair of contacts, cause the other of the pair of contacts and the second pair of contacts to open.

In one embodiment, an apparatus includes a first circuit breaker and a second circuit breaker. The first circuit breaker includes a first input connector configured to be electrically connected to a first conductor and a control mechanism operably coupled to a first pair of contacts. The control mechanism is configured to selectively open and close the first pair of contacts in response to a control signal. In this manner, the first pair of contacts controls a flow of current through the first conductor. The control mechanism may be a solenoid or a motor that responds to the control signal to separate the first pair of contacts.

The second circuit breaker includes a second input connector configured to be electrically connected to a second conductor and a trip mechanism operably coupled to a second pair of contacts. The trip mechanism is configured to selectively open the second pair of contacts in response to an overload event on the second conductor. In this manner, the second pair of contacts controls a flow of current through the second conductor. The first circuit breaker is mechanically connected to the second circuit breaker such that the first input connector and the second input connector are electrically isolated from one another. The controlled circuit breaker and the uncontrolled circuit breaker may be configured to share a neutral conductor.

In one embodiment, the controlled circuit breaker includes a trip mechanism operably coupled to the first pair of contacts, or alternatively, a third pair of contacts. The trip mechanism is configured to open the first pair, or alternately, the third pair, of contacts to interrupt the current generated by the first voltage phase in response to an overload event.

In one embodiment, the controlled circuit breaker includes a first handle manually operable to open a pair of contacts to interrupt the current generated by the first voltage phase. The uncontrolled circuit breaker also includes a second handle manually operable to open the second pair of contacts to interrupt the current generated by the second voltage phase. The apparatus further comprises a handle tie that mechanically couples the first handle to the second handle such that operation of one of the first and second handles will open the pair of contacts and the second pair of contacts to interrupt the current generated by the first voltage phase and the current generated by the second voltage phase.

In one embodiment, the apparatus includes a common trip mechanism coupled between a pair of contacts in the controlled circuit breaker and the second pair of contacts in the uncontrolled circuit breaker. The common trip mechanism is configured to, in response to opening of one of the pair of contacts and the second pair of contacts, cause the other of the pair of contacts and the second pair of contacts to open.

In one embodiment, a system includes an uncontrolled circuit breaker, a controlled circuit breaker, a first outlet, and a second outlet. The uncontrolled circuit breaker is connected to a first conductor in a first circuit. The first conductor is connected to a first electrical phase. The controlled circuit breaker is connected to a second conductor in a second circuit. The second conductor is connected to a second electrical phase that is different from the first electrical phase. The first outlet receives power from the first conductor; and the second outlet receives power from the second conductor. The first outlet and second outlet may be disposed on a same duplex outlet or different duplex outlets. The first and second circuits may share a neutral conductor.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. One of ordinary skill in the art will appreciate that in some embodiments one element may be designed as multiple elements or that multiple elements may be designed as one element. In some embodiments, an element shown as an internal component of another element may be implemented as an external component and vice versa. Furthermore, elements may not be drawn to scale.

DETAILED DESCRIPTION

Figure 1:
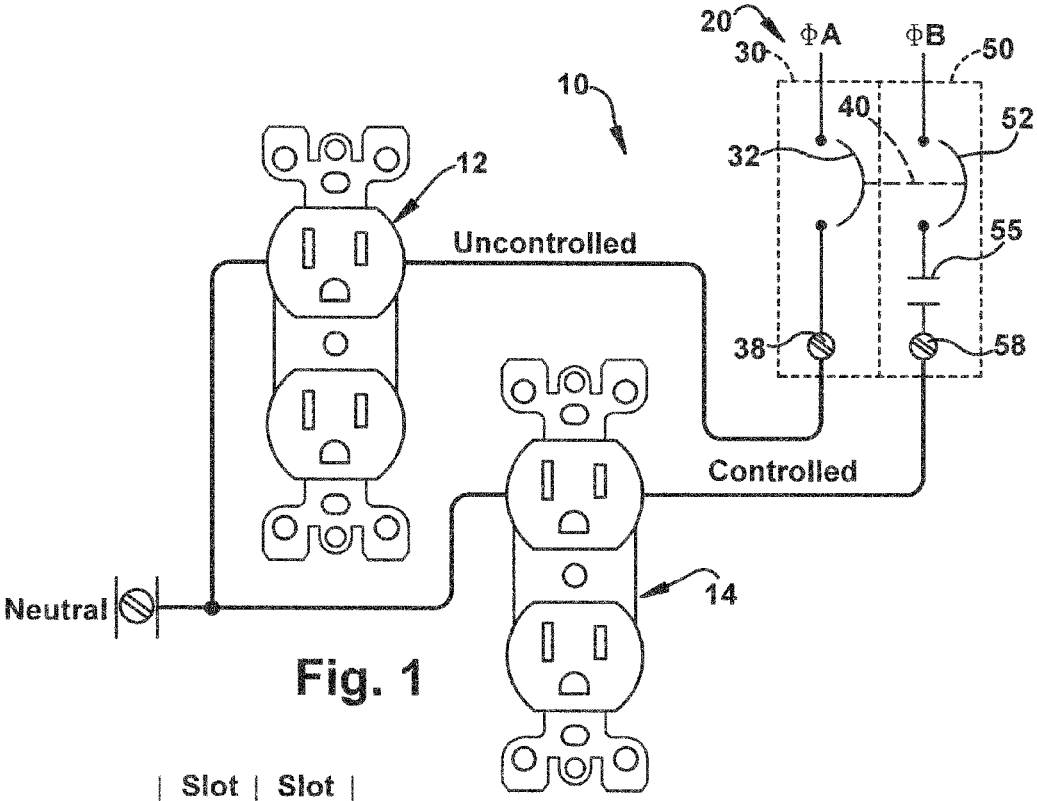
FIG. 1 is a schematic illustration of an electrical power circuit that includes one embodiment of a hybrid control circuit breaker.

Energy codes set minimum requirements for energy-efficient design and construction for new and renovated buildings. Over the next few years switched receptacles will become law as energy codes are updated across the United States. Remote control circuit breaker systems provide a convenient method to meet this new requirement.

With every update of 90.1, ASHRAE sets a goal to improve energy savings over the previous version. With many improvements to lighting and HVAC efficiency already in place, miscellaneous electrical loads became an obvious target for additional energy savings. Non-essential plug loads are almost always left connected to receptacles when occupants are away. The "stand-by" power that these loads consume is a significant portion of energy consumption. The portion of energy consumption by non-essential plug loads will continue to rise as the efficiency of other systems improves. Controllable plug loads, such as task lights, printers, and computer monitors can be automatically "unplugged" by simply switching off the power supplied to the receptacle.

ASHRAE 90.1-2010 Section 8.4.2 stipulates automatic shut-off control of at least 50% of the receptacles installed in private offices, open offices and computer classrooms, including receptacles installed in modular partitions. Control options for shut-off include a time-of-day schedule, occupancy sensor, or by a signal from another system. This new requirement ensures that the controlled receptacle capability is provided in a building but allows flexibility in how it is used. At least one switched receptacle is to be provided near each uncontrolled receptacle. Occupants have the choice whether a load is plugged into a controlled receptacle. The occupant ultimately decides which loads are suitable for automatic shut-off without causing disruption to their business.

There are several ways that a building can be made to comply with Section 8.4.2. Switching of the controlled receptacle circuit can occur at either a remote controlled circuit breaker panel, a relay panel, or by an occupancy sensor located in the controlled area. The remote controlled circuit breaker panel is a versatile option. The remote controlled circuit breaker panel will already include an internal time clock for time-of-day control to meet the control requirement. Additionally, the remote controlled circuit breaker panel is capable of responding to external signals from occupancy sensors or other systems via a simple connection. The hybrid control circuit breaker described herein is configured to provide remote controlled and uncontrolled circuit breaker capabilities in a single unit that is suitable for being installed in the remote controlled circuit breaker panel.

Sharing a neutral conductor among several circuits is a common practice in commercial construction since it reduces the total number of wires, reduces voltage loss and heat, and reduces conduit fill. This practice is more likely with the new requirement to control receptacles since two circuits can supply a split duplex receptacle, two duplex receptacles in the same wall box, or even separated receptacles in the same area. It is a natural approach to wiring, especially when a centralized control system is used for switching a circuit. But particular attention needs to be paid to ensuring that controlled and uncontrolled receptacles follow electrical code requirements for multi-wire branch circuits when both do not originate from the same branch circuit.

A potentially non-compliant situation exists when receptacles supplied from different circuits on the same phase share a neutral conductor. The current through the neutral conductor is the total supplied by the two circuits, potentially exceeding the rating. Although the neutral conductor could be an appropriately sized larger gauge of wire, a second problem remains when the circuit is serviced if both branches are not disconnected. It is not possible to link the two branch breakers with a handle tie to create a simultaneous disconnect means since same phases are not adjacent in the circuit breaker panel. Keeping the two circuits separate by using individual neutral wires and locating the receptacles in different wall boxes would avoid these hazards. The hybrid control circuit breaker described herein is configured to be installed in adjacent slots in the circuit breaker panel. Input connections for the remote controlled circuit breaker and the uncontrolled circuit breaker are separate from one another. When installed in a panel, the remote control circuit then controls a branch circuit on a first phase and the uncontrolled circuit breaker supplies a branch circuit on a second phase.

FIG. 1 shows an electrical circuit 10 that includes one embodiment of a hybrid control circuit breaker 20. (Only two phases are shown for clarity.) The hybrid control circuit breaker 20 includes an uncontrolled circuit breaker 30. For the purposes of this description, an uncontrolled circuit breaker is a circuit breaker that is not equipped to disconnect power in response to a control signal (e.g., timer, occupancy sensor). An uncontrolled circuit breaker is configured to disconnect power in response to an overload event. The uncontrolled circuit breaker 30 includes a handle 32 that allows a user to manually operate the circuit breaker. The uncontrolled circuit breaker 30 is connected to phase A and controls power in an uncontrolled branch circuit that includes a duplex outlet 12 that supplies power from phase A.

Figure 2:
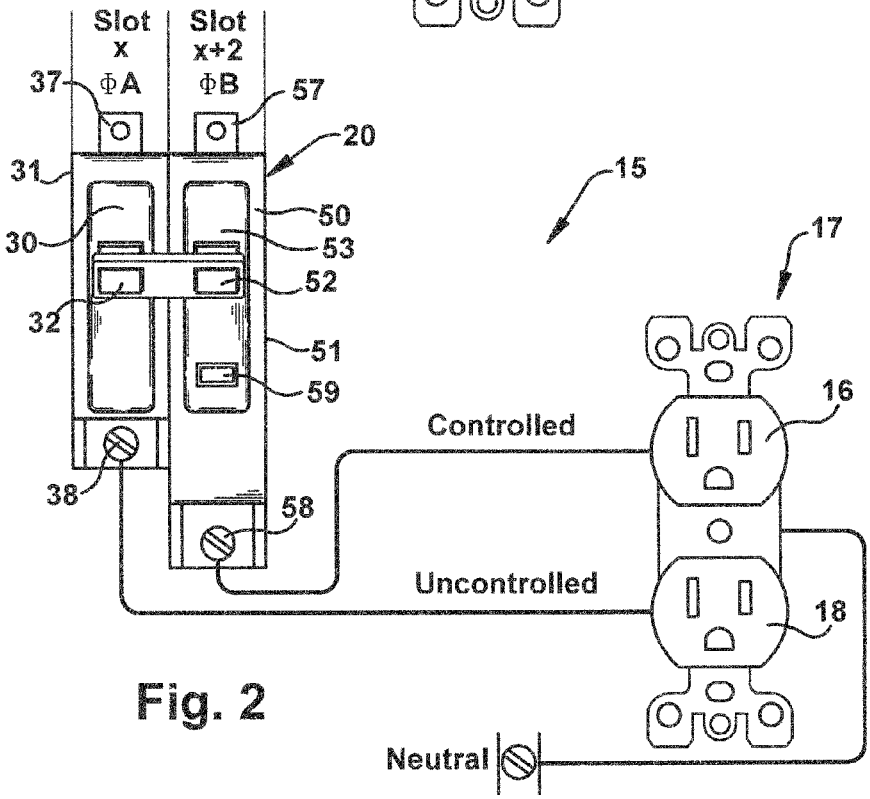
FIG. 2 is a schematic illustration of another electrical power circuit that includes one embodiment of a hybrid control circuit breaker.
Figure 3:
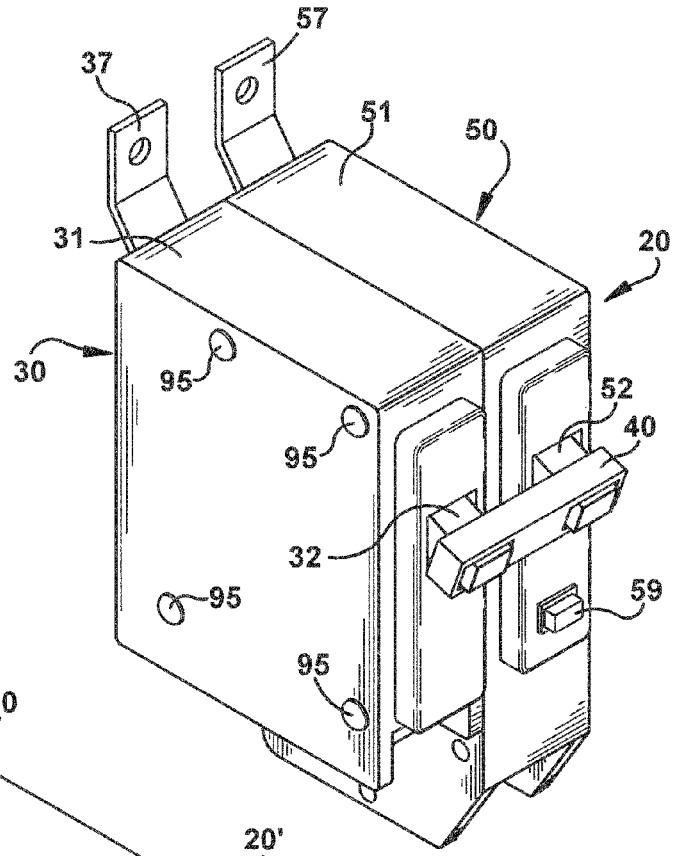
FIG. 3 is a perspective view of one embodiment of a hybrid control circuit breaker.
Figure 4:
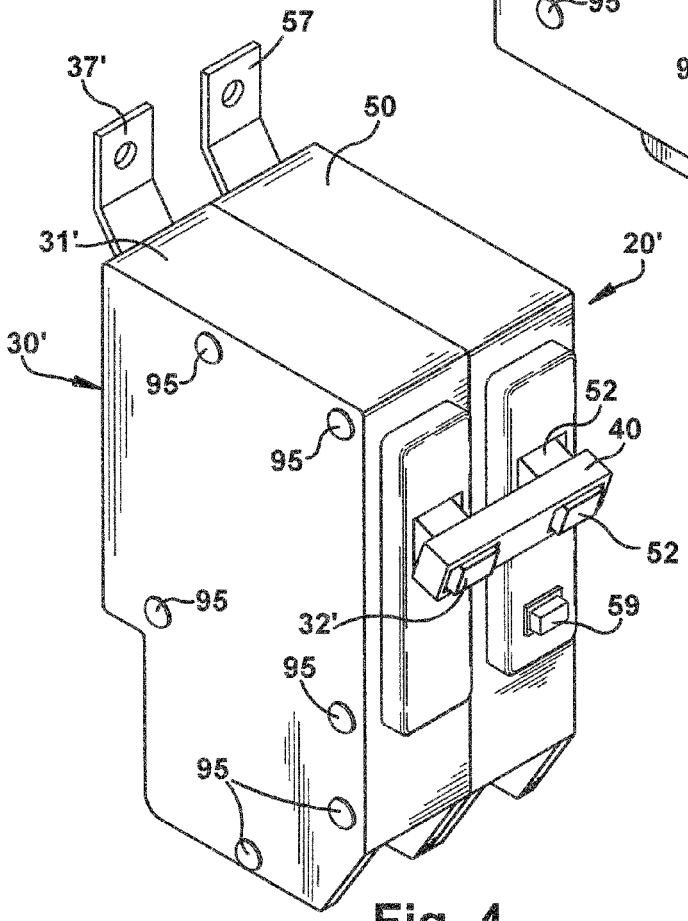
FIG. 4 is a perspective view of one embodiment of a hybrid control circuit breaker.

The hybrid control circuit breaker 20 includes a controlled circuit breaker 50. For the purposes of this description, a controlled circuit breaker is a circuit breaker that is equipped to disconnect power in response to a control signal. Controlled circuit breakers may be called "remote controlled"

circuit breakers in some contexts. The control feature of the controlled circuit breaker 50 is designated by the normally open contact symbol 55. The controlled circuit breaker 50 may also sometimes be distinguished by an override handle 59 (FIGS. 2-4). The override handle can be used to manually close remotely controlled contacts in the controlled circuit breaker 50 (see FIG. 5). The position of the override handle 59 indicates a status of the controlled contacts in the circuit breaker 50. For example, when remotely controlled contacts are closed, a red region may be visible. The red region may be covered by the override handle 59 when the remotely controlled contacts are open.

Figure 5:
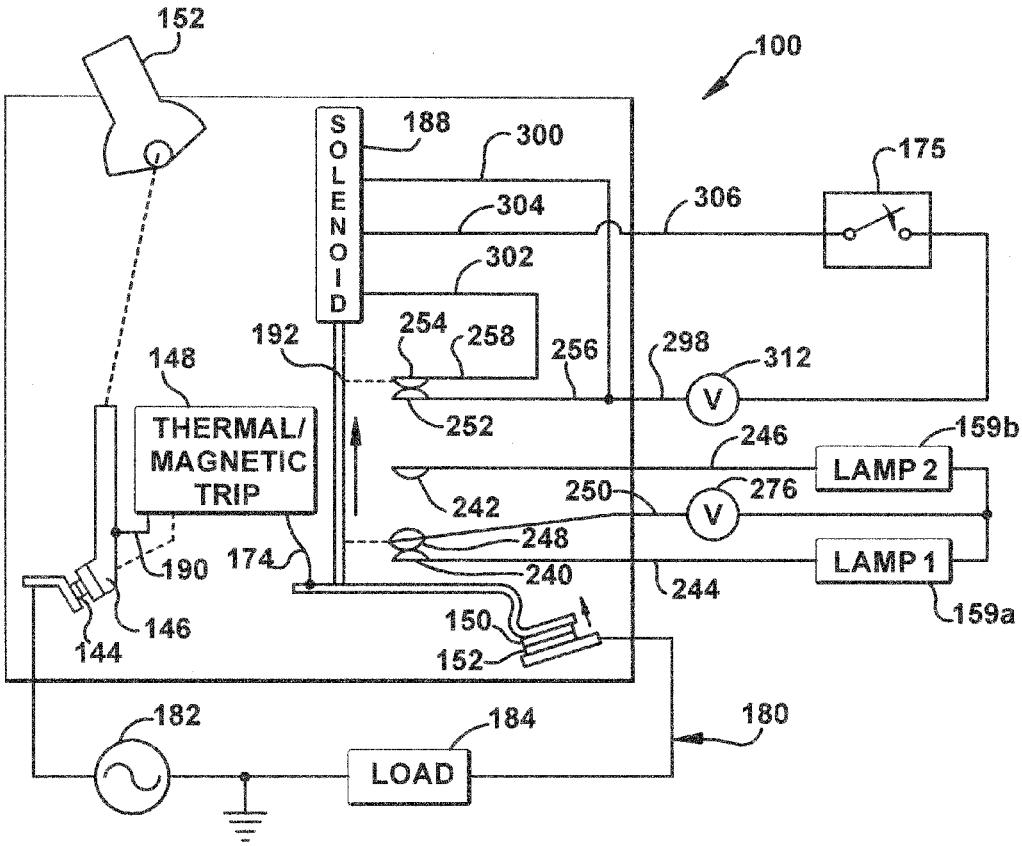
FIG. 5 is a schematic view of one embodiment of a controlled circuit breaker.

The controlled circuit breaker 50 also includes a reset handle 52 that allows a user to manually operate contacts in the circuit breaker that are controlled by thermal (overload) conditions. The controlled circuit breaker 50 is connected to phase B and controls power in a controlled branch circuit including a duplex outlet 14 that supplies power from phase B. An example embodiment of a controlled circuit breaker is shown in FIG. 5. Example controlled circuit breakers are described in U.S. Pat. Nos. 5,301,083 and 6,888,431, both of which are incorporated herein by reference in their entirety.

Both the controlled branch circuit and the uncontrolled branch circuit may share a neutral conductor. A handle tie shown schematically as dashed line 40 mechanically couples the handle 32 to the handle 52. This connection between the handles of two circuit breakers is required by some electrical codes when circuits controlled by the two breakers share a neutral.

In some embodiments, the hybrid control circuit breaker 20 is implemented using a multi-pole circuit breaker in which one of the poles is remote controlled. In the multi-pole circuit breaker, the overload trip mechanisms of the uncontrolled circuit breaker 30 and the controlled circuit breaker 50 are connected to one another with a common trip mechanism (not shown, internal to circuit breaker), such as a common trip bar, that causes adjacent poles to trip when a given pole trips due to an overload event. A multi-pole hybrid control circuit breaker with the common trip mechanism could be used in the shared neutral configuration described in FIGS. 1 and 2. The multi-pole hybrid control circuit breaker could also be used in a phase to phase application because it provides a common trip mechanism between adjacent circuit breaker poles.

FIG. 2 shows another electrical circuit 15 that includes the hybrid control circuit breaker 20. The hybrid control circuit breaker 20 is installed in adjacent slots x and x+2 in a circuit breaker panel (panel not shown). By convention, adjacent slots in a circuit breaker panel (e.g., slot x and slot x+2) are connected to different phases. An input connector 37 of the uncontrolled circuit breaker 30 is installed in slot x and an input connector 57 of the controlled circuit breaker 50 is installed in slot x+2. The input connector 37 and the input connector 57 are electrically separate or isolated so that different phases are input to the uncontrolled circuit breaker 30 and the controlled circuit breaker 50 when the hybrid control circuit breaker 20 is installed in a panel. The uncontrolled circuit breaker 30 is connected, by way of connection fastener 38, in a branch circuit on phase A. The controlled circuit breaker 50 is connected, by way of connection fastener 58, in a branch circuit on phase B. In the electrical circuit 15, a duplex outlet 17 is provided that includes a controlled outlet 16 connected to phase B and an uncontrolled outlet 18 connected to phase A.

In the circuits shown in FIGS. 1 and 2, the cancellation effect of the phases actually reduces the current flowing through the neutral conductor, reducing it all the way to zero when the current flowing through each branch is equal. The branch circuit breakers can either be linked with a handle tie 40 (as shown) to assure that power is removed simultaneously, or a two or three pole breaker could be used. The simultaneous disconnect feature prevents back-feed from the shared circuit that could possibly damage equipment should the neutral be disconnected from the panel.

FIG. 3 illustrates a perspective view of the hybrid control circuit breaker 20 that shows how a housing 31 of the uncontrolled circuit breaker 30 is mechanically fastened to a housing 51 of the controlled circuit breaker 50 by way of fasteners 95 (e.g., rivets, screws). FIG. 4 illustrates a perspective view of another embodiment of a hybrid control circuit breaker 20'. The hybrid control circuit breaker 20' includes an uncontrolled circuit breaker 30' that is implemented using a controlled circuit breaker with the control feature disabled or removed.

FIG. 5 illustrates schematically one embodiment of a controlled circuit breaker 100 installed in a controlled branch circuit 180. The circuit breaker 100 is only one of many possible controlled circuit breakers that can be used in a hybrid control circuit breaker. The branch circuit includes a current source 182 that provides current to a load 184. The controlled circuit breaker 100 is capable of selectively interrupting the flow of current through the branch circuit 180. The controlled circuit breaker includes a first pair of contacts 150, 152 and a second pair of contacts 144, 146 in series with the first pair of contacts. Thus, both pairs of contacts 150, 152 and 144, 146 must be closed for current to flow in the branch circuit 180.

The first set of contacts 150, 152 is controlled by a solenoid 188 that is actuated by a control switch 175 as will be described in more detail below. Thus, the switch 175 is responsive to a control signal (e.g., timer, occupancy sensor) to cause the solenoid 188 to open the contacts 150, 152. The second set of contacts 144, 146 are controlled by both a handle 152 and a trip mechanism 148. The operable mechanical connection between the handle 152 and the trip mechanism 148 and the second set of contacts 144, 146 is shown in dashed line. The operation of the handle 152 and trip mechanism 148, which can be effectuated in any of many known ways is not described in detail here.

The solenoid 188 operates a plunger 192 that is operably connected the first set of contacts 150, 152. When a control circuit for the solenoid 188 is unpowered (e.g., switch 175 is open), the plunger 192 is urged by an internal spring (not shown) into the extended or downward position shown in FIG. 5. The solenoid 188 includes a pickup coil energized by a control signal current on conductor 302, and a holding coil energized by a control signal current on conductor 300. Conductor 304 provides a common return.

When it is desired to disconnect power from the load 184, the remote switch 175 is closed, which completes a circuit from the voltage source 312 through conductor 298, a terminal 256, contacts 252, 254, a terminal 258 and conductor 302 to the pickup coil of solenoid 188, which circuit is returned through conductor 304, conductor 306 and the closed switch 175 to the source 312. A circuit is also completed from the voltage source 312 through conductor 298, and terminal 300 to energize the holding coil of the solenoid 188. Energization of the pickup coil and holding coil of the solenoid 188 causes upward retraction of the solenoid plunger 192 (as indicated by the arrow in FIG. 5), to open relay contacts 150, 152, and hence stop current flow to the load 184. During upward movement of the plunger, the contact terminal arm 258, which is mechanically coupled to the plunger 192 moves the contact 254 upwardly out of engagement with contact 252, to break the circuit to the solenoid pickup coil. Only the holding coil is necessary to hold the plunger in its upward position. The bias of the internal spring that urges the plunger downward is small and easily overcome.

When plunger 192 is in its downward position, contacts 248 and 240 are closed, which completes a circuit through a voltage source 276 and a lamp 159*a*, which indicates that relay contacts 150 and 152 are closed, which in turn indicates that current is being supplied to load 184 (in the absence of a tripped condition of breaker contacts 144, 146), thus providing load management information and positive feedback indication. When the plunger 192 is in its upper position, the contacts 248 and 242 are closed, which completes a circuit through the voltage source 276 and a lamp 159*b*, indicating that relay contacts 150 and 152 are open, which in turn indicates that current is not being supplied to load 184. The lamps 159*a* and 159*b* may be incorporated into the indicator light 59 of FIGS. 2-4. In the embodiment shown in FIG. 4, the uncontrolled circuit breaker 30' may be implemented using the controlled circuit breaker 100 without power being supplied to the voltage source 312. While the solenoid 188 is the means of separating the contacts in response to a control signal in the described embodiment, a motor or other mechanism may be used.

The hybrid control circuit breakers described herein require no special methods for wiring and no additional labor for installation. There are no additional devices to mount or equipment to install. The electrical contractor can simply wire receptacle circuits to a circuit breaker as they have always done. There are no additional connections through interposing relays or other devices since the circuit breaker has an internal relay. Having receptacle control imbedded inside the electrical gear reduces the number of products required on a job. No extra space is needed in the electric closet for an additional panel.

Contractors are already required to clearly mark each breaker to indicate the connection. If hybrid control circuit breakers are used, the separation of controlled and uncontrolled receptacles occurs in one location where they can be precisely labeled according to their function. More importantly, it would be evident which circuits share a common neutral and that they are connected to different phases. A handle tie across these same breakers allows easy identification, a common disconnect and simplifies lock-out tag-out safety procedures. In a remote controlled circuit breaker panel, all of the equipment is concentrated in one place for simple verification. Other approaches can require a more tedious and time consuming verification process.

One hybrid control circuit breaker manages an entire circuit of receptacles, potentially doing the job of many discrete devices. When designing a project, panel schedules can be marked by the engineer to indicate the controlled circuits, which correspond to the designated switched receptacles on the electrical drawing. Wiring per plan by the electrical contractor will ensure that the switched receptacle count meets the design intent. Instead of relying on occupancy or a schedule, receptacles can be controlled by the "armed away" status signal from the security system or a system can logically combine multiple methods, such as using a schedule during normal business hours and an occupancy sensor at night. An added benefit is that savings generated by receptacle control can be calculated and logged as part of the system.

While for purposes of simplicity of explanation, the illustrated methodologies in the figures are shown and described as a series of blocks, it is to be appreciated that the methodologies are not limited by the order of the blocks, as some blocks can occur in different orders and/or concurrently with other blocks from that shown and described. Moreover, less than all the illustrated blocks may be used to implement an example methodology. Blocks may be combined or separated into multiple components. Furthermore, additional and/or alternative methodologies can employ additional blocks that are not illustrated.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the disclosure is not limited to the specific details, the representative apparatus, and illustrative examples shown and described. Thus, this application is intended to embrace alterations, modifications, and variations that fall within the scope of the appended claims.

To the extent that the term "includes" or "including" is employed in the detailed description or the claims, it is intended to be inclusive in a manner similar to the term "comprising" as that term is interpreted when employed as a transitional word in a claim.

To the extent that the term "or" is used in the detailed description or claims (e.g., A or B) it is intended to mean "A or B or both". When the applicants intend to indicate "only A or B but not both" then the phrase "only A or B but not both" will be used. Thus, use of the term "or" herein is the inclusive, and not the exclusive use. See, Bryan A. Garner, A Dictionary of Modern Legal Usage 624 (2d. Ed. 1995).

To the extent that the phrase "one or more of, A, B, and C" is used herein, (e.g., a data store configured to store one or more of, A, B, and C) it is intended to convey the set of possibilities A, B, C, AB, AC, BC, and/or ABC (e.g., the data store may store only A, only B, only C, A&B, A&C, B&C, and/or A&B&C). It is not intended to require one of A, one of B, and one of C. When the applicants intend to indicate "at least one of A, at least one of B, and at least one of C", then the phrasing "at least one of A, at least one of B, and at least one of C" will be used.

What is claimed is:

1. An apparatus, comprising:

a controlled circuit breaker configured to input and output current generated by a first voltage phase, and further comprising a control mechanism operably coupled to a first pair of separable contacts and configured to selectively open the first pair of separable contacts to interrupt the current generated by the first voltage phase in response to a control signal;

an uncontrolled circuit breaker configured to input and output current generated by a second voltage phase that is different than the first voltage phase, and further comprising a trip mechanism configured to selectively open a second pair of separable contacts to interrupt the current generated by the second voltage phase in response to an overload event; and where the controlled circuit breaker and the uncontrolled circuit breaker are mechanically connected to one another in fixed relative positions such that when the apparatus is installed in a circuit breaker panel, the controlled circuit breaker and the uncontrolled circuit breaker are installed in adjacent slots.

2. The apparatus of claim 1 where the controlled circuit breaker and the uncontrolled circuit breaker are configured to share a neutral conductor.

3. The apparatus of claim 1 where the controlled circuit breaker further comprises a trip mechanism configured to open the first pair of contacts to interrupt the current generated by the first voltage phase in response to an overload event.

4. The apparatus of claim 1 where the controlled circuit breaker comprises a trip mechanism operably coupled to a third pair of contacts connected in series with the first pair of contacts, where the trip mechanism is configured to open the third pair of contacts to interrupt the current generated by the first voltage phase in response to an overload event.

5. The apparatus of claim 1 where the control mechanism comprises a solenoid that responds to the control signal to separate the first pair of contacts.

6. The apparatus of claim 1 where the control mechanism comprises a motor that responds to the control signal to separate the first pair of contacts.

7. The apparatus, of claim 1 where:

the controlled circuit breaker further comprises a first handle manually operable to open a pair of contacts to interrupt the current generated by the first voltage phase;

the uncontrolled circuit breaker further comprises a second handle manually operable to open the second pair of contacts to interrupt the current generated by the second voltage phase; and where the apparatus further comprises a handle tie that mechanically couples the first handle to the second handle such that operation of one of the first and second handles will open the pair of contacts and the second pair of contacts to interrupt the current generated by the first voltage phase and the current generated by the second voltage phase.

8. The apparatus of claim 7 comprising a common trip mechanism coupled between the pair of contacts in the controlled circuit breaker and the second pair of contacts in the uncontrolled circuit breaker, the common trip mechanism configured to, in response to opening of one of the pair of contacts and the second pair of contacts, cause the other of the pair of contacts and the second pair of contacts to open.

9. An apparatus comprising:

a first circuit breaker comprising:

a first input connector configured to be electrically connected to a first conductor; and a control mechanism operably coupled to a first pair of contacts and configured to selectively open and close the first pair of contacts in response to a control signal, the first pair of contacts controlling a flow of current through the first conductor;

a second circuit breaker comprising:

a second input connector configured to be electrically connected to a second conductor; and a trip mechanism operably coupled to a second pair of contacts and configured to selectively open the second pair of contacts in response to an overload event on the second conductor, the second pair of contacts controlling a flow of current through the second conductor; and where the first circuit breaker is mechanically connected to the second circuit breaker such that the first input connector and the second input connector are electrically isolated from one another.

10. The apparatus of claim 9 where the controlled circuit breaker and the uncontrolled circuit breaker are configured to share a neutral conductor.

11. The apparatus of claim 9 where the controlled circuit breaker comprises a trip mechanism operably coupled to the first pair of contacts, where the trip mechanism is configured to open the first pair of contacts to interrupt the current generated by the first voltage phase in response to an overload event.

12. The apparatus of claim 9 where the controlled circuit breaker comprises a trip mechanism operably coupled to a third pair of contacts connected in series with the first pair of contacts, where the trip mechanism is configured to open the third pair of contacts to interrupt the current generated by the first voltage phase in response to an overload event.

13. The apparatus of claim 9 where the control mechanism comprises a solenoid that responds to the control signal to separate the first pair of contacts.

14. The apparatus of claim 9 where the control mechanism comprises a motor that responds to the control signal to separate the first pair of contacts.

15. The apparatus of claim 9 where:

the controlled circuit breaker further comprises a first handle manually operable to open a pair of contacts to interrupt the current generated by the first voltage phase;

the uncontrolled circuit breaker further comprises a second handle manually operable to open the second pair of contacts to interrupt the current generated by the second voltage phase; and where the apparatus further comprises a handle tie that mechanically couples the first handle to the second handle such that operation of one of the first and second handles will open the pair of contacts and the second pair of contacts to interrupt the current generated by the first voltage phase and the current generated by the second voltage phase.

16. The apparatus of claim 15 comprising a common trip mechanism coupled between the pair of contacts in the controlled circuit breaker and the second pair of contacts in the uncontrolled circuit breaker, the common trip mechanism configured to, in response to opening of one of the pair of contacts and the second pair of contacts, cause the other of the pair of contacts and the second pair of contacts to open.

17. A system, comprising:

an uncontrolled circuit breaker connected to a first conductor in a first circuit, the first conductor connected to a first electrical phase;

a controlled circuit breaker connected to a second conductor in a second circuit, the second conductor connected to a second electrical phase that is different from the first electrical phase;

a first outlet receiving power from the first conductor; and a second outlet receiving power from the second conductor.

18. The system of claim 17 where the first outlet and second outlet are disposed on a same duplex outlet.

19. The system of claim 17 where the first outlet and second outlet are disposed on different duplex outlets.

20. The system of claim 17 where the first and second circuits share a neutral conductor.

* * * * *